United States Patent [19]

Henville

[11] 4,318,464

[45] Mar. 9, 1982

[54] HINGE MECHANISM FOR A COIN TESTING MECHANISM

[75] Inventor: Michael I. Henville, Maidenhead, England

[73] Assignee: Mars, Incorporated, McLean, Va.

[21] Appl. No.: 113,207

[22] Filed: Jan. 18, 1980

[51] Int. Cl.[3] ..... G07F 9/04

[52] U.S. Cl. ..... 194/97 R

[58] Field of Search ..... 194/97 R, 97 B, 99, 194/102, 100, 100 A, 101, DIG. 29, 2

[56] References Cited

U.S. PATENT DOCUMENTS 2,239,050 4/1941 Patzer et al. ..... 194/97 R
3,382,962 5/1968 Nielsen ..... 194/97
4,106,608 8/1978 Dietz ..... 194/1 R

FOREIGN PATENT DOCUMENTS 2744945 4/1979 Fed. Rep. of Germany .
2753377 5/1979 Fed. Rep. of Germany .

*Primary Examiner*—Stanley H. Tollberg
*Attorney, Agent, or Firm*—Davis, Hoxie, Faithfull & Hapgood

[57] ABSTRACT

A mechanism for testing coins having two confronting plates connected by a hinge is provided with mechanism to allow translatory movement of the plates to allow for greater separation of the plates in the vicinity of the hinge.

8 Claims, 7 Drawing Figures

HINGE MECHANISM FOR A COIN TESTING MECHANISM

FIELD OF THE INVENTION

The present invention relates to a hinge mechanism for mounting together two plates. It is especially concerned with a hinge mechanism for mounting the flight deck of a coin testing mechanism.

BACKGROUND OF THE INVENTION

In a coin testing mechanism a passageway for coins is usually formed by two closely spaced plates. A track carried by one of the plates supports the coins on their edges and defines the path which coins follow between the plates. Coin testing devices are arranged at positions alongside the path. Sometimes coins become jammed in the mechanism and it is necessary to provide means for separating the plates sufficiently to allow the jammed coins to fall from the track. In the known arrangements the plates are joined to one another by a simple hinge and a mechanism is provided for swinging the plates apart about the hinge when a coin is jammed.

The space available for a coin mechanism in a vending machine is often limited, particularly the depth from front to back. It has been found that in some instances there is insufficient depth to allow the plates to be swung apart sufficiently for coins close to the hinge axis to be released. The aim of the present invention is to provide a mechanism which overcomes this problem.

SUMMARY OF THE INVENTION

According to the present invention there is provided an assembly comprising a hinge mechanism connecting two plates, the hinge mechanism comprising a hinge pin mounted parallel to the plate for movement in a slot perpendicular to the plane of one of the plates, the other plate being pivotally mounted about the axis of the hinge pin, first biasing means biasing the plates together about the hinge axis and second biasing means biasing the hinge pin towards the said one plate, actuating means being operable to cause the plates to pivot about the hinge axis against the action of the first biasing means and to move apart at the hinge axis against the action of the second biasing means.

Conveniently the first biasing means may comprise a coil spring disposed around the hinge pin and bearing on the one hand against part of the one plate or a part carried by the said one plate and on the other hand against the other plate. The second biasing means may comprise a leaf spring carried by the one plate and coupled to the hinge pin. The coupling may conveniently be provided by a coil spring serving as the first biasing means.

The actuating means may be a lever pivoted on the one plate and carrying a cam surface which cooperates with a cam follower surface on the other plate to force the plates apart when the lever is operated.

The two plates 12 and 13 are coupled by a hinge pin 19 which passes through slots 21 in lugs 22 on the plate 13 and holes in lugs 20 on the plate 12. A coil spring 23 is disposed around the hinge pin 19 and has its free ends secured to a cantilever leaf spring 28 secured to the plate 13. The slots 21 extend perpendicular to the plate 13 and the springs 23 and 28 co-operate to hold the hinge pin 19 in the bottom of the slots 21. The coil spring has a central loop 24 which bears against the edge of the plate 12 and thus serves to bias the two plates together about the hinge axis. A lever 31 pivoted on the plate 13 carries a cam surface 32 which co-operates with a cam follower surface 35 on the plate 12 so that when the lever is actuated the plates are forced progressively apart by the cam surface riding up the cam follower surface. The coil spring 23 initially allows the plate 12 to pivot about the hinge axis away from the plate 13 but eventually plate 12 strikes an abutment 38 which prevents further rotation of the plate. Further movement of the cam surface up the cam follower surface causes the leaf spring 28 to flex and allow separation of the plates along the edges adjacent the hinge pin 19.

BRIEF DESCRIPTION OF THE DRAWINGS

An embodiment of the invention will now be described by way of example with reference to the accompanying drawings of which.

DETAILED DESCRIPTION OF THE EMBODIMENT

Figure 1:
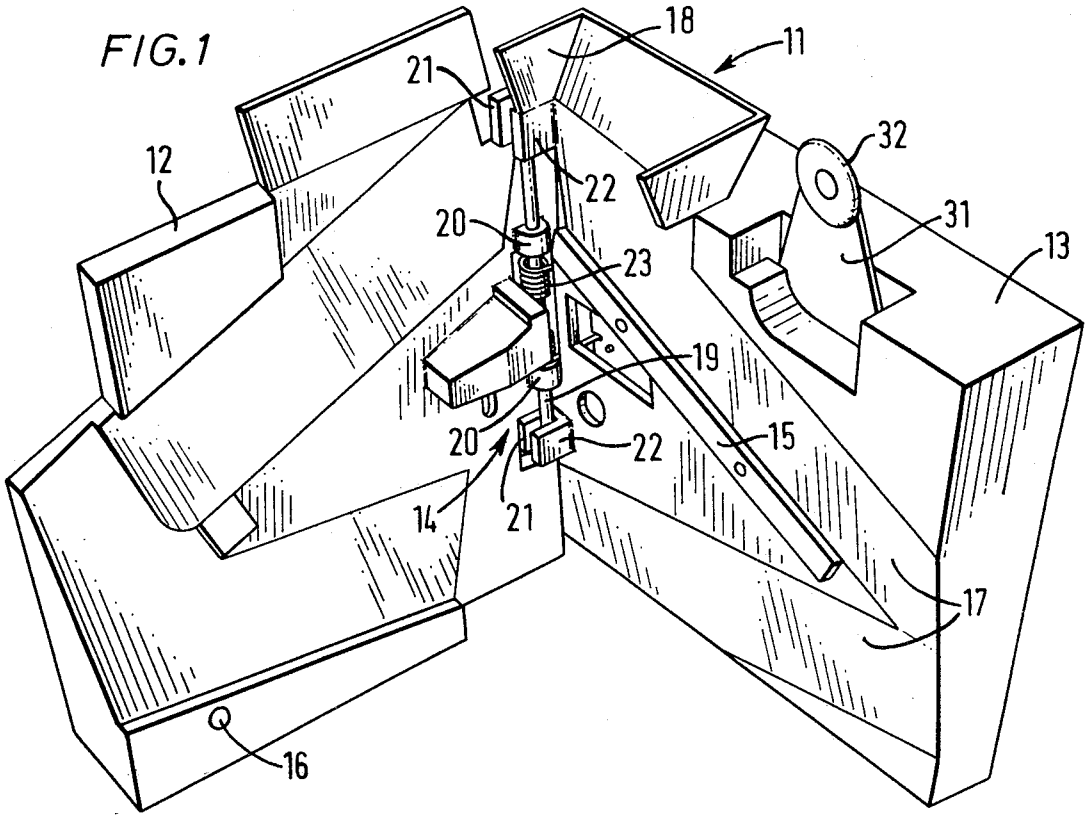
FIG. 1 shows two plates of a coin mechanism connected by a hinge mechanism according to the invention.
Figure 2:
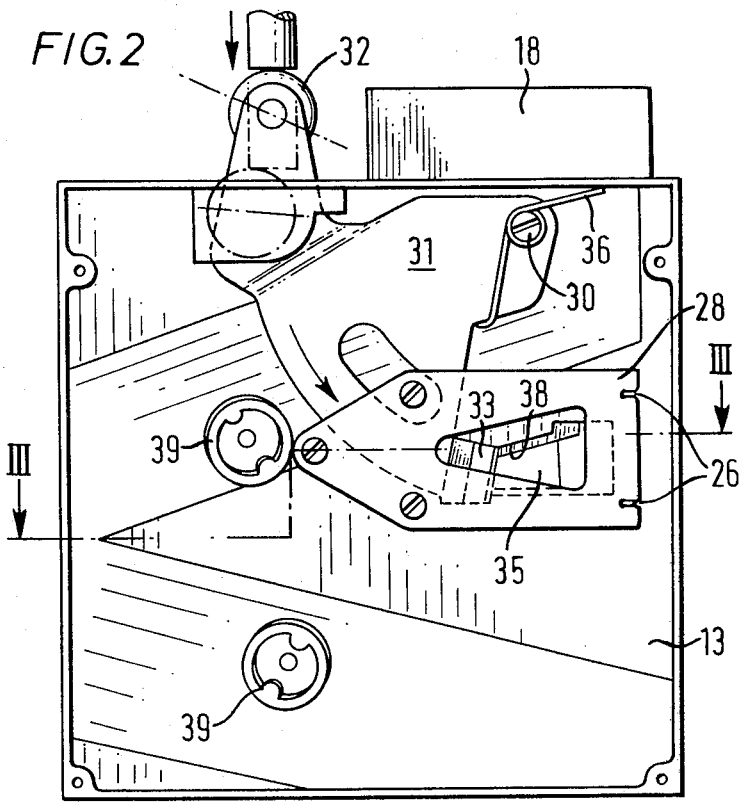
FIG. 2 shows a back view of one of the plates of FIG. 1.
Figure 7:
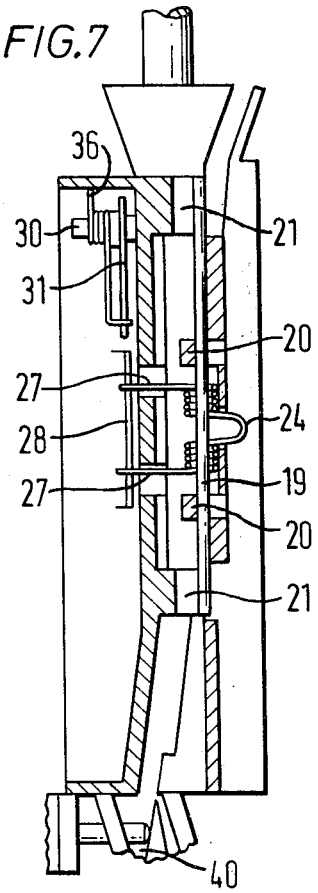
FIG. 7 shows a vertical section on the line VII—VII of FIG. 5.

Referring to the drawings, these show part of a coin testing mechanism 11. In FIG. 1 the parts are shown opened out more than they would be in normal everyday use. The mechanism does however permit the parts to be opened out as far as is illustrated for ease of cleaning. The mechanism comprises two plates 12 and 13 connected together by a hinge mechanism 14. Rails 15 and 16 carried by the plates 13 and 12 provide a coin track which supports the coins on their edges and define, when the two plates 12 and 13 are closed together, a zig-zag coin path 17 through the mechanism. Coins inserted into the mechanism through a hopper 18 roll under gravity along the track 15, fall off its lower end onto track 16, roll down the track 16 and fall off its lower end into the lower part 40 of the coin mechanism (see FIG. 7). Alongside the coin path are located the various coin testing devices, for example inductive sensor 39 as shown in FIG. 2 of the kind described in our U.S. Pat. No. 1,397,083, which determine the authenticity and the denomination of the coins inserted.

The hinge mechanism 14 comprises a hinge pin 19 which passes through two vertically-spaced lugs 20 on the plate 12. The ends of the hinge pin 19 are received in slots 21 in two vertically-spaced lugs 22 on the plate 13. The slots 21 extend in a vertical plane perpendicular to the plane of the plate 13. Thus the hinge pin 19 serves to connect the plates 12 and 13 together and allow rotational movement relative to one another about the hinge axis and translational movement of the plates 12 in a direction perpendicular to the plane of the plate 13.

The plates 12 and 13 are biased together into the closed position by means of a coil spring 23. The central part of the coil spring is formed into a loop 24 which bears against the edge 25 of the plate 12. The ends 26 of the wire of the coil spring 23 extend through holes 27 in the plate 13 and are fixed to a leaf spring 28. The leaf spring 28 is carried on posts 29 on the back of the plate 13. The free end of the leaf spring 28 which carries the ends 26 of the coil spring 23 is spaced from the back of the back plate 13 and acting through the coil spring 23 holds the hinge pin 19 at the bases of the slots 21 in the lugs 22. Thus in the normal condition the two plates are close together at the hinge axis and lie parallel to one another.

For separating the plates an actuating mechanism in the form of a lever 31 is provided. The lever is pivotally mounted on a post 30 carried by the plate 13 so as to rotate about an axis normal to the plane of the plate 13. At one end the lever 31 has an operating handle 32 which depending on the particular coin mechanism in which it is used, may be operated by the person using the vending machine either directly or indirectly through a linkage. The other end of the lever 31 carries a cam surface 33.

A boss 34 on the plate 12 projects across the gap between the plates and through an opening 38 in the plate 13. The boss carries a cam follower surface 35 which is inclined relative to the plane of the plate 12.

Figure 3:
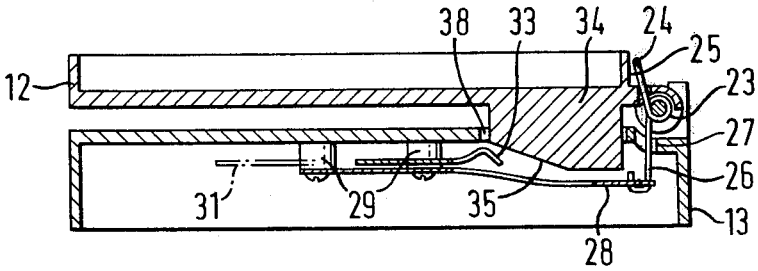
FIG. 3 shows a horizontal section on the line III—III of FIG. 2.
Figure 4:
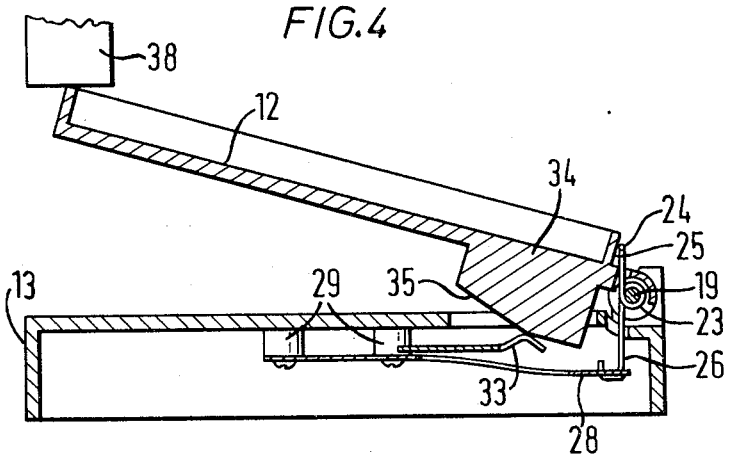
FIG. 4 shows a horizontal section on the line III—III with the plates in a different position relative to one another.
Figure 5:
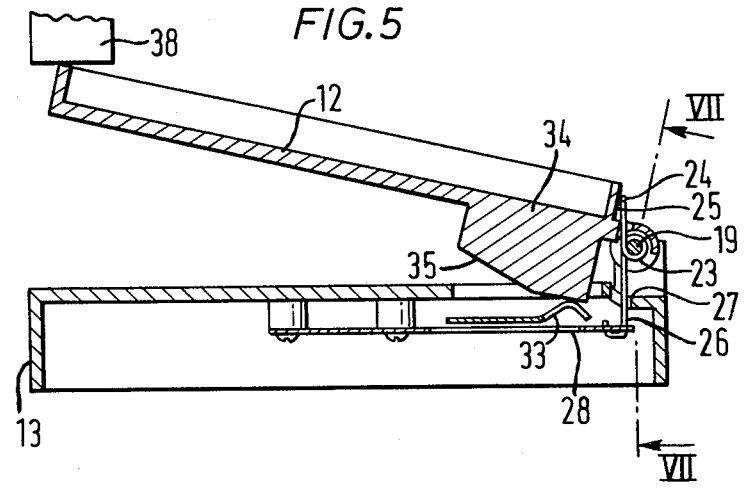
FIG. 5 shows a horizontal section on the line III with the plates in yet another position, relative to one another.
Figure 6:
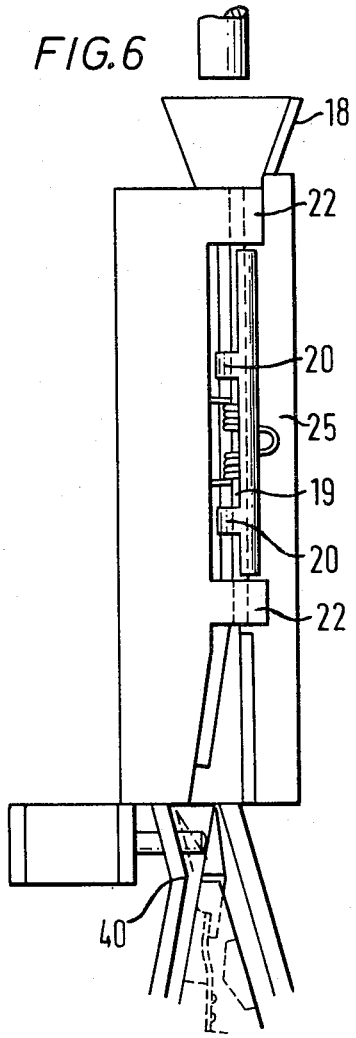
FIG. 6 shows a side elevation of the mechanism of FIGS. 1 to 5.

The lever 31 is biased by a spring 36 so that the operating handle 32 is normally in the raised position and the cam portion 33 is situated opposite the part of the boss 34 which has a lower height relative to the plate 12 (the left hand end as viewed in FIG. 3). When the operating end of the lever 32 is depressed the cam portion 33 rides up the ramp formed by the cam follower surface 35 as it moves to the right as viewed in FIGS. 3, 4 and 5. This action causes the plates to pivot about the axis of the hinge from the normal closed parallel position of FIG. 3 into the position shown in FIG. 4 in which the plates are spaced apart at the left hand edges. The relative strength and configurations of the springs 23 and 28 are such that the force required to produce rotation about the hinge axis is less than is necessary to cause deflection of the leaf spring. When the plates reach the position shown in FIG. 4 the free edge of the plate 12 strikes a fixed abutment 38 which may be part of the casing of the coin mechanism. This prevents further rotation of the plate 12 about the hinge axis. Further rotation of the lever 31 about its pivot axis causes the cam follower to ride up the less steeply sloping portion of the cam surface 35. The plate 12 rotates about its point of contact with the abutment 38 causing the hinge pin 19 to move outwardly in the slots 21 and the leaf spring 28 to be deflected into the position shown in FIG. 5. Thus the spacing between the plates at the side adjacent the hinge 19 is increased.

It will be understood that when a coin is jammed in the mechanism shown in the drawings it can be released by operating the lever 31 to separate the plates and allow the coins to fall from the track. The mechanism shown in the drawings has the advantage that when a coin is jammed close to the hinge axis separation of the plates sufficient to allow the coin to fall from the track can be achieved even though the amount by which the plates can be separated at the left hand end is limited.

Modifications of the design described above are possible without departing from the scope of the present invention. For example we have found that it is possible to produce separation of the plates at the hinge pin without the use of a fixed abutment 38. By arranging the spring forces of the cantilever spring 28 and the coil spring 23 to balance one another, both plates can be caused to separate substantially parallel to one another by the cam 33. We have found that a cam follower surface 35 which has a single slope is particularly suitable for this arrangement, that is to say the flat area for the final portion of the cam surface is eliminated.

I claim:

1. An assembly for a coin testing mechanism, comprising a hinge mechanism, two plates connected by the hinge mechanism, the hinge mechanism comprising a slot which extends generally perpendicular to the plane of one of the plates, a hinge pin mounted parallel to the plates for movement in said slot, the other plate being pivotally mounted about the axis of the hinge pin, first biasing means biasing the plates together about the hinge axis and second biasing means biasing the hinge pin towards the said one plate, and actuating means operable to cause the plates to pivot about the hinge axis against the action of the first biasing means and to move apart at the hinge axis against the action of the second biasing means.

2. An assembly according to claim 1 in which the first biasing means comprises a coil spring disposed around the hinge pin and bearing on the one hand, against a part on the plate and, on the other hand, against the other plate.

3. An assembly according to claim 1 in which the second biasing means comprises a leaf spring carried by the one plate and coupled to the hinge pin.

4. An assembly according to claim 3 in which the coupling is provided by a coil spring disposed around the hinge pin and serving as the first biasing means.

5. An assembly according to claim 1 in which the actuating means is a lever pivoted on the one plate, a cam surface carried by the lever, and a cam follower surface on the other plate and which cooperates with said cam surface to force the plates apart when the lever is operated.

6. An assembly according to claim 1 in which the relative strengths and configurations of the biasing means are such that the force required at the actuating means to produce rotation about the hinge axis is less than is necessary to cause displacement of the hinge pin away from the said one plate.

7. An assembly according to claim 6 including a housing having an abutment which is engaged by the edge of the said other plate remote from the hinge to limit the rotation of the said other plate about the hinge pin.

8. An assembly according to claim 1 in which the relative strengths and configurations of the biasing means are such that the force required at the actuating means to produce rotation about the hinge pin is equal to the force required to cause displacement of the hinge pin away from the said one plate.

* * * * *

UNITED STATES PATENT AND TRADEMARK OFFICE

CERTIFICATE OF CORRECTION

PATENT NO. : 4,318,464

DATED : March 9, 1982

INVENTOR(S) : Michael I. Henville

It is certified that error appears in the above-identified patent and that said Letters Patent are hereby corrected as shown below:

Col. 1, line 36, "plate" should be --plates--.

Col. 4, line 34 (claim 2), before "plate" insert --one--.

Signed and Sealed this

*Thirteenth* Day of *July 1982*

[SEAL]

*Attest:*

GERALD J. MOSSINGHOFF

*Attesting Officer*

*Commissioner of Patents and Trademarks*